US008008558B2

(12) United States Patent
Koentopp

(10) Patent No.: US 8,008,558 B2
(45) Date of Patent: Aug. 30, 2011

(54) FOCUSED INPUT STRINGED INSTRUMENT

(76) Inventor: Daniel Koentopp, Chicago, IL (US)

( * ) Notice: Subject to any disclaimer, the term of this patent is extended or adjusted under 35 U.S.C. 154(b) by 273 days.

(21) Appl. No.: 11/934,757

(22) Filed: Nov. 3, 2007

(65) Prior Publication Data

US 2008/0127800 A1 Jun. 5, 2008

Related U.S. Application Data

(60) Provisional application No. 60/856,544, filed on Nov. 4, 2006.

(51) Int. Cl.
*G10D 3/00* (2006.01)

(52) U.S. Cl. ..... 84/291; 84/293; 84/290; 84/267

(58) Field of Classification Search ..... 84/291
See application file for complete search history.

(56) References Cited

U.S. PATENT DOCUMENTS

| | | | | |
|---|---|---|---|---|
| 3,185,011 | A | 5/1965 | Anderson | |
| 3,439,570 | A | 4/1969 | Lee | |
| 3,538,807 | A | 11/1970 | Francis | |
| 3,657,462 | A | 4/1972 | Robinson | |
| 4,295,403 | A | 10/1981 | Harris | |
| 4,930,389 | A * | 6/1990 | Kunstadt | 84/293 |
| 5,025,695 | A * | 6/1991 | Viel | 84/293 |
| 5,347,904 | A | 9/1994 | Lawrence | |
| 5,654,514 | A * | 8/1997 | Tracey | 84/327 |
| 5,661,252 | A * | 8/1997 | Krawczak | 84/291 |
| 5,679,910 | A * | 10/1997 | Steinberger et al. | 84/291 |
| 5,682,003 | A | 10/1997 | Jarowsky | |
| 5,929,362 | A | 7/1999 | Oteyza | |
| 6,372,970 | B1 * | 4/2002 | Saunders et al. | 84/293 |
| 6,646,191 | B1 | 11/2003 | Martin | |
| 2005/0076764 | A1 * | 4/2005 | Davis | 84/299 |

* cited by examiner

*Primary Examiner* — Elvin G Enad

*Assistant Examiner* — Christopher Uhlir

(74) *Attorney, Agent, or Firm* — Sabre Technical Services Corp.

(57) ABSTRACT

The invention is a stringed instrument having string vibrations transmitted through a bridge directly to an interaction region of a soundboard, to the exclusion of vibrations via other paths.

15 Claims, 11 Drawing Sheets

FOCUSED INPUT STRINGED INSTRUMENT

The invention is a stringed instrument having string vibrations transmitted through a bridge directly to an interaction region of a soundboard, to the exclusion of vibrations via other paths. The instrument produces optimal sound from the soundboard by focusing string vibrations through the bridge at the interaction region of the soundboard while minimizing string vibrations to the soundboard via other paths.

The instrument has a hollow body formed by body sides, a body bottom and a body top. The instrument has a vibrationally-responsive soundboard. The soundboard forms at least a part of the body top.

The instrument has at least one string connected to a neck. The string is stretched between a neck head and a distal neck tail. The neck is connected to the body medial the head and the tail in such a way as to minimize paths for string vibrations to reach the soundboard.

The bridge is mounted on the soundboard medial the neck head and the neck tail, and between the string and the soundboard so that the stretched string presses the bridge into the soundboard.

The soundboard comprises an interaction region where string vibrational interactions through the bridge occur directly. The string contacts only the neck and the bridge, and the neck is substantially spaced apart from the soundboard so that string vibrations are focused through the bridge at the interaction region. The interaction region is isolated from string vibrational interactions other than through the bridge.

By focusing string vibrations at the interaction region, and by isolating the region from other vibrational interactions, the instrument of the invention achieves superior sound quality that most accurately reproduces the string vibrations through the bridge via the soundboard.

Direct string vibrational interactions occur only through the bridge and only at the interaction region.

The instrument intensifies the relationship between the vibrating string and the vibrating soundboard so that the sounds produced by the soundboard correlate most directly to the string vibrations. High correlation between the vibrating string and the vibrating soundboard is beneficial to producing desirable sounds.

String vibrations can follow various other paths to reach the interaction region but these vibrations diminish significantly in strength before reaching the interaction region. For example, some highly attenuated vibrations can travel from the vibrating string through air to the interaction region. Similarly, vibrations can travel from the string to the neck, then from the neck to the instrument body, and then from the instrument body through the soundboard to the interaction region. Again, vibrational interactions reaching the interaction region via such paths will be attenuated so that their contribution to soundboard vibration is minimized.

Many conventional stringed instruments utilize a bridge mounted to a soundboard to transmit string vibrations to the soundboard. Strings alone do not move a lot of air, which is advantageous for producing loud sounds. The soundboard provides a large surface area that can be vibrated by the string via the bridge. The vibrating soundboard can move more air than the string alone can move, and so the instrument produces a louder sound by vibrating the soundboard than via the string alone.

The relationship between the vibrating string and the vibrating soundboard affects the quality of the sound produced by the stringed instrument. The instrument of the invention is designed to minimize soundboard conditions that might distort and alter the relationship between the string vibration and the soundboard vibration.

It is well known that multiple vibrations in a medium can superimpose and can modify both frequency and amplitude of the original vibrations. Such superimposition in the soundboard can result in different sounds than would be produced by the soundboard if the soundboard were acted upon by the string vibrations through the bridge only.

Many conventional string instruments connect strings to a tailpiece that is fixed directly to the soundboard. As such, strong string vibrations travel to the soundboard through the bridge and also through the tailpiece. The vibrations from both the tailpiece and the bridge affect the sound produced by the vibrating soundboard.

Additionally, the tension of the string is applied directly to the soundboard via the connected tailpiece, resulting in significant stress throughout the soundboard. This stress can affect the soundboard as the soundboard reacts to the string vibrations through the bridge and through the tailpiece, resulting in different sounds than would be produced by the soundboard if it were acted upon by the string vibrations through the bridge only.

Alternatively, some conventional string instruments connect the string to a tailpiece that is fixed directly to the instrument body but not to the soundboard, for example directly to the body side and directly to the body bottom. In this case, strong string vibrations travel to the soundboard through the bridge and also through the body via tailpiece. The vibrations from the tailpiece, the body, and the bridge all affect the sound produced by the vibrating soundboard.

Also, as in the preceding example, string tension is applied to the soundboard via the instrument body and again results in significant stress throughout the soundboard. As in the preceding example, the stressed soundboard produces different sounds than would be produced by the soundboard if it were acted upon by the string vibrations through the bridge only.

The instrument of the invention connects the string at distal ends of the neck so that primarily the neck resists the string tension. This design results in the instrument body, including the soundboard, being substantially free of stress due to string tension.

DRAWINGS

Figure 1:
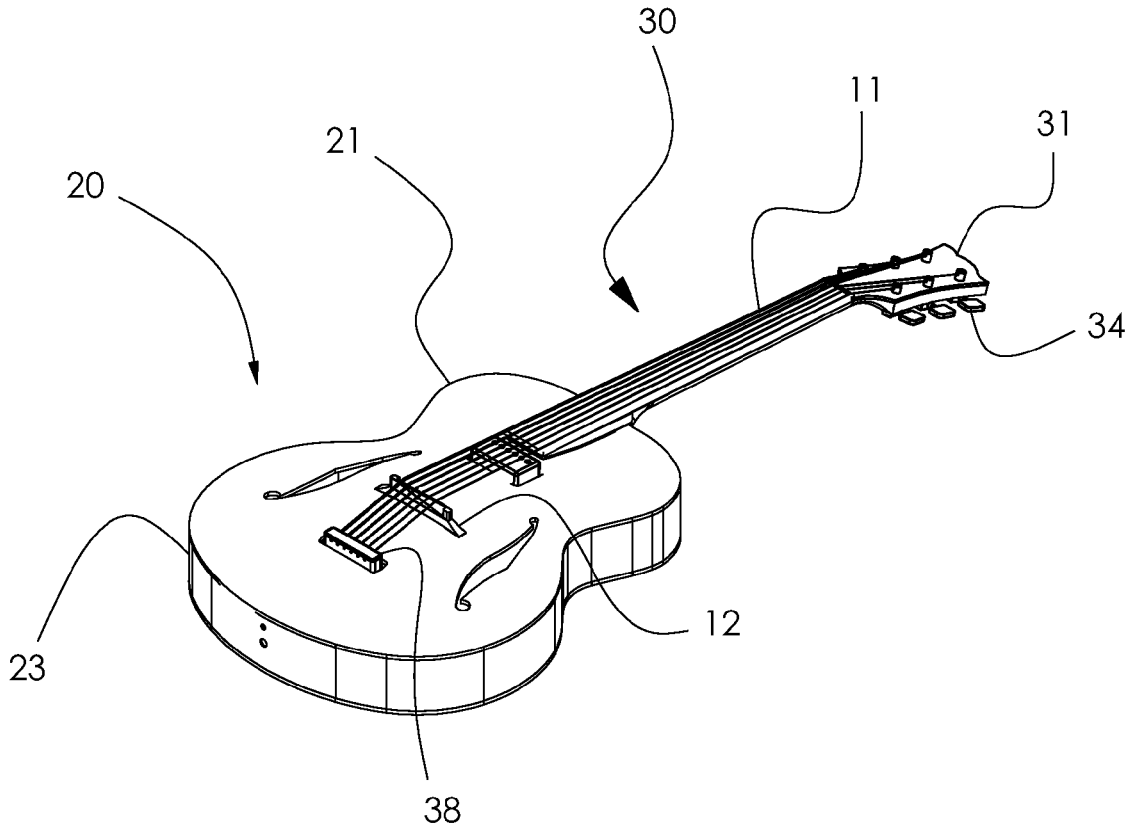
FIG. 1 is an isometric view of an instrument of the invention.

The invention is a stringed instrument 10. The instrument comprises a hollow body 20. The hollow body is formed by body sides 23, a body bottom 22, and a body top 21.

Additionally, the instrument 10 can have a heel block 28 and a neck block 29. The blocks provide strength and stiffness to the body.

Typically, the sides, top, bottom, and blocks are connected by edge-gluing. The blocks provide large gluing surfaces for positioning and holding body parts with respect to each other.

Figure 2:
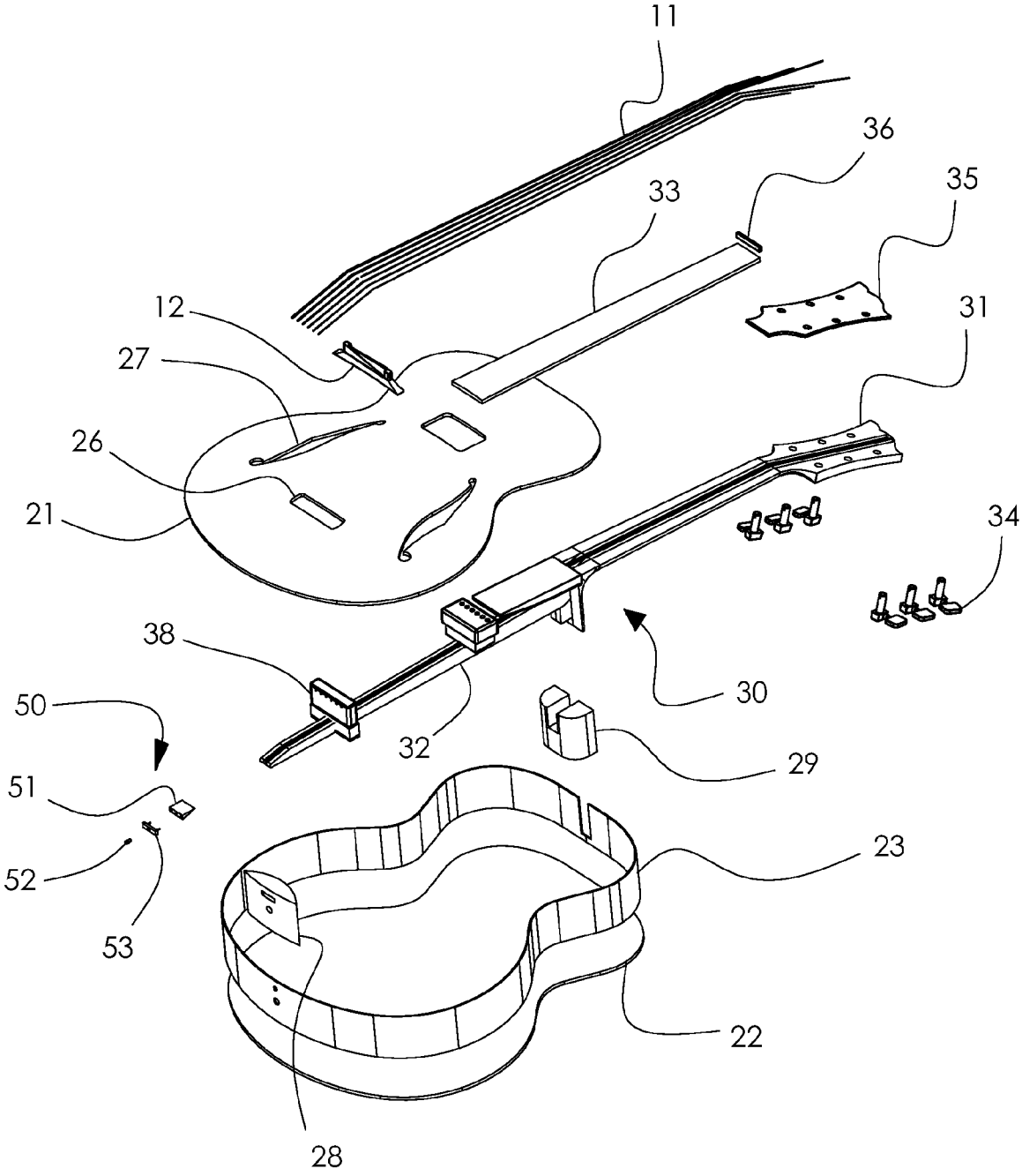
FIG. 2 is an exploded view of the instrument.

The sides, top, and bottom can comprise substantially separate components, as shown in FIG. 2, and can comprise combination components where sides, top, and bottom are single components of various combinations. For example, body sides and bottom can comprise a single combination component, formed unitarily from a material.

The sides, top, and bottom can be connected by various connecting methods, for example, by gluing, by welding, by riveting, by tongue and groove, and various methods and combinations thereof.

The body top comprises a vibrationally-responsive soundboard 24. The soundboard can cause sound by vibrating and moving air within and without the hollow body.

Figure 3:
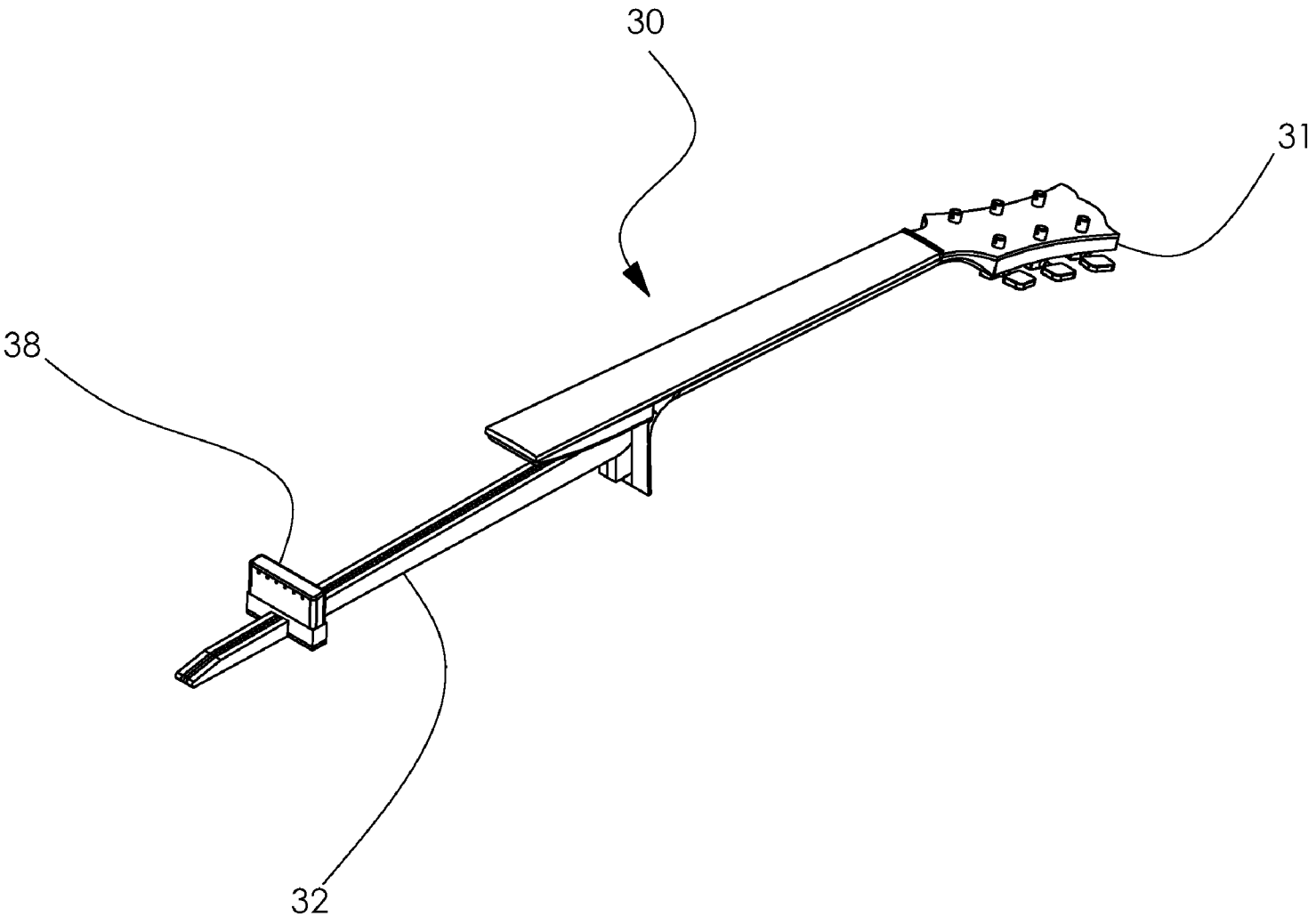
FIG. 3 is an isometric view of an instrument neck.

The body top is substantially rigid and vibrationally-unresponsive proximal the connections between the top and other body components. The soundboard 24 is substantially distal the glued connections between the top, sides, and blocks, as shown in FIG. 3 within the dashed lines.

The instrument has a neck 30 comprising a head 31 and a tail 32. The neck 30 is fixed to the body 20 medial the head 31 and the tail 32. The neck extends away from the body to the head. The tail 32 extends through the body 20 and into the hollow body. The tail within the hollow body is substantially spaced apart from the soundboard so that the soundboard can vibrate freely without interference from the tail.

The instrument comprises at least one string 11 connected to the head and to the tail. The string is stretched between the head and the tail so that the string can vibrate. The string passes over at least a part of the soundboard between the head and the tail. The string is spaced apart from the soundboard.

Figure 4:
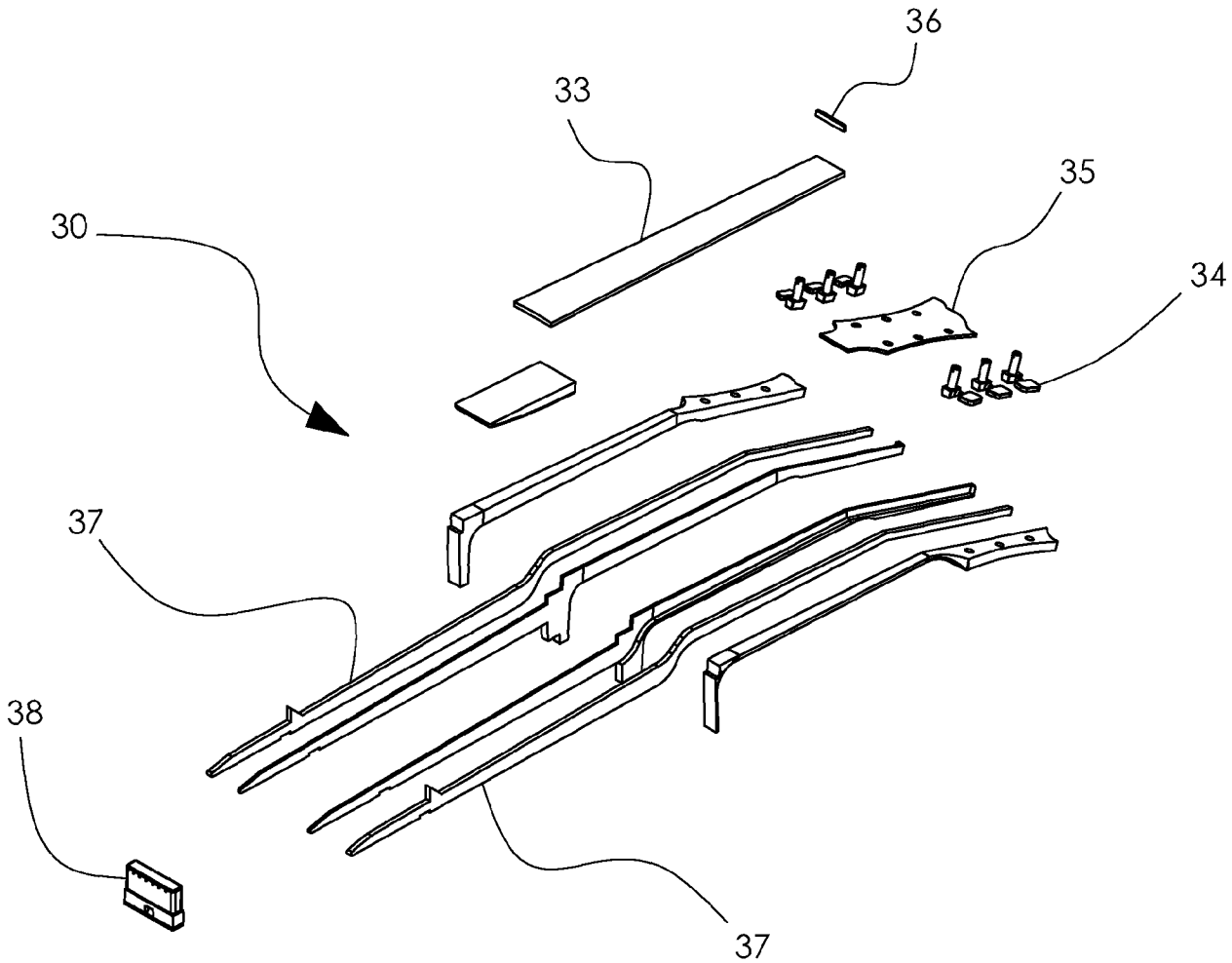
FIG. 4 is an exploded view of an instrument neck.
Figure 5:
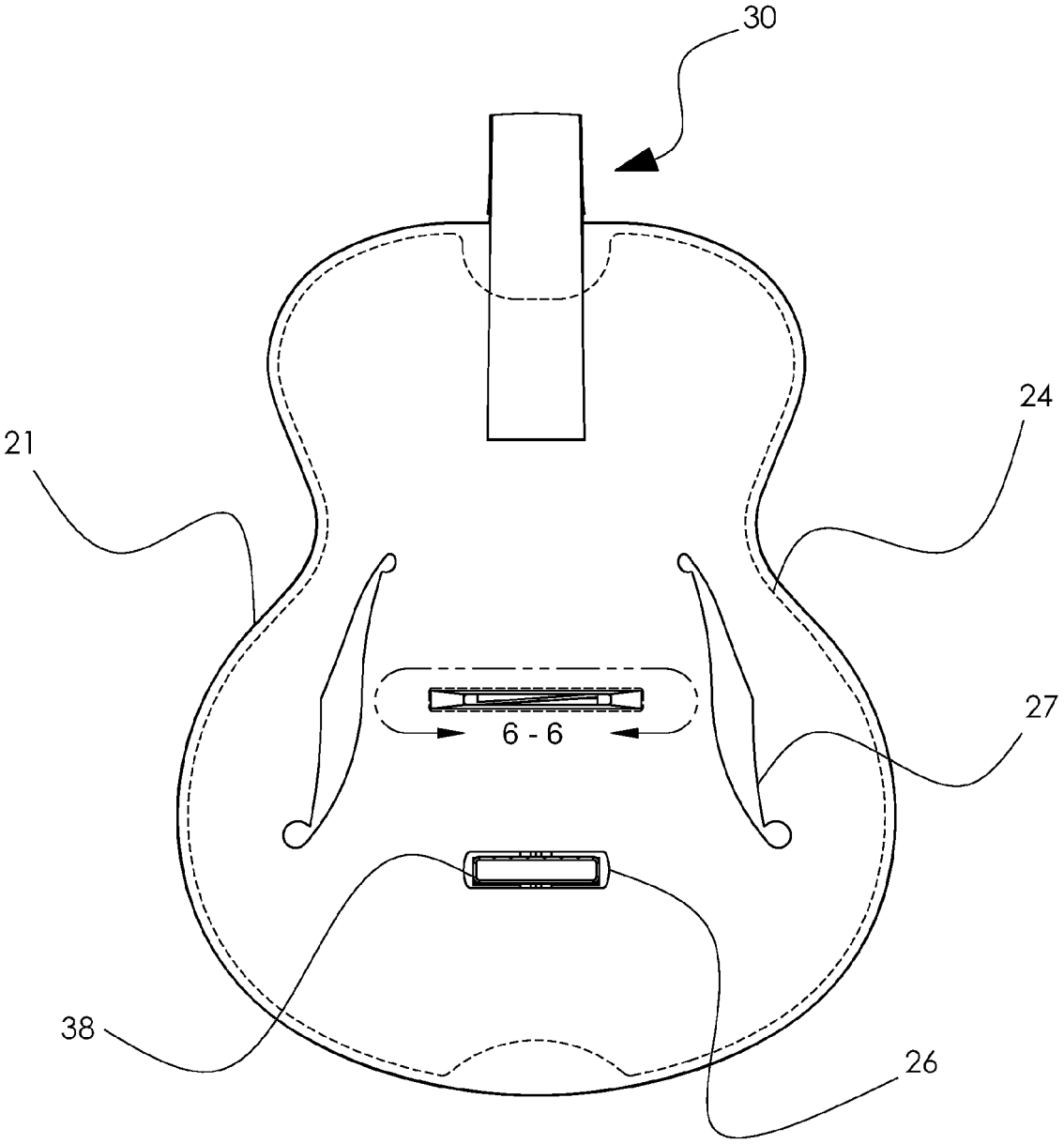
FIG. 5 is a top view of a part of the instrument.
Figure 6:
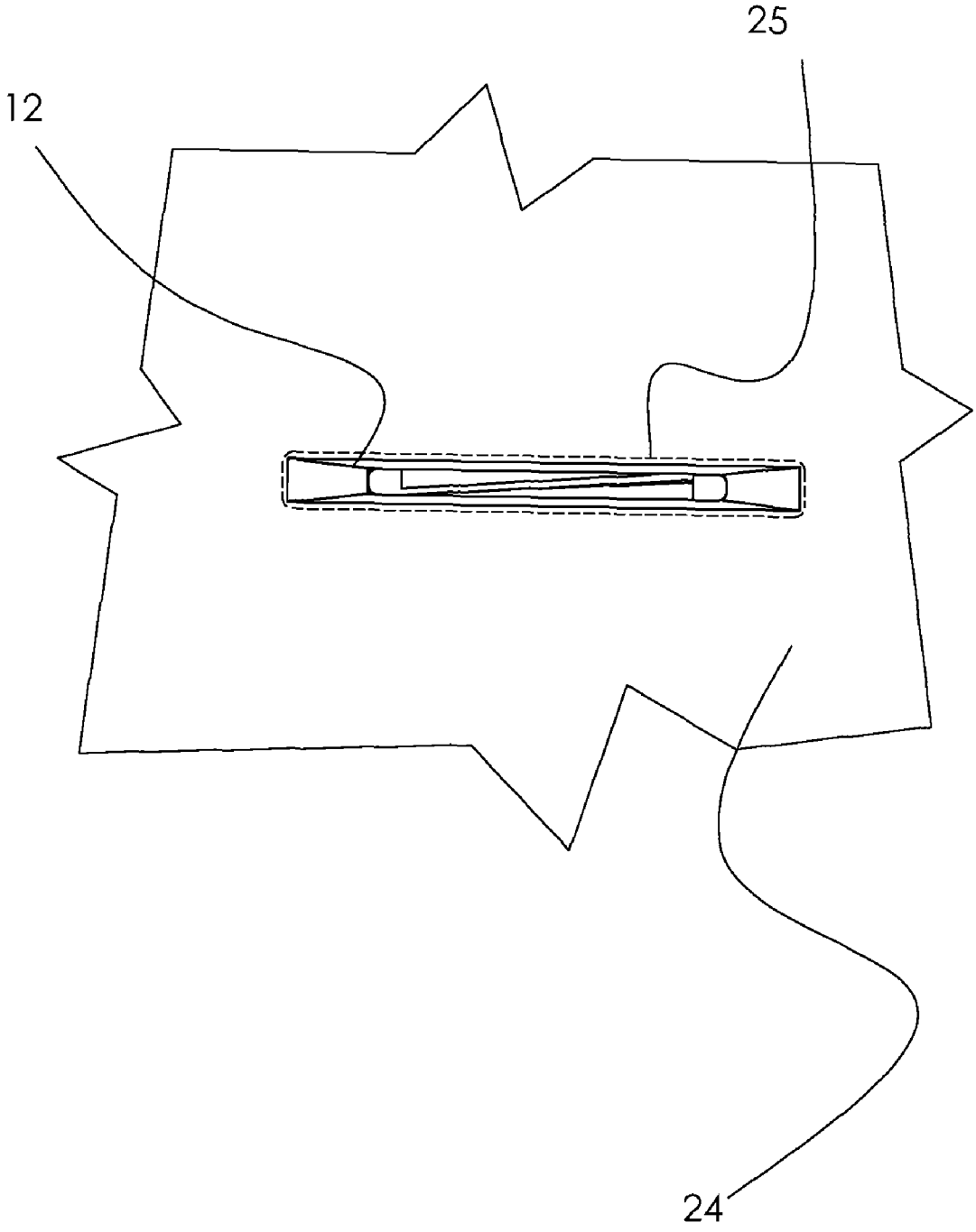
FIG. 6 is detail view indicated by line 6-6 of a bridge and an interaction region of the instrument.
Figure 7:
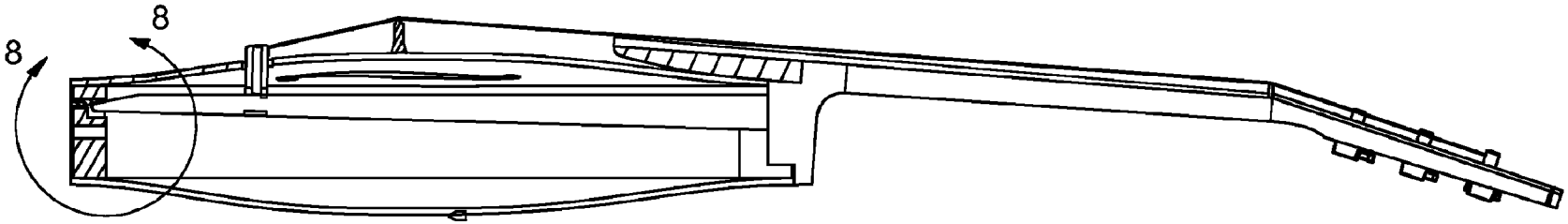
FIG. 7 is a side section view of an instrument.

The neck can comprise various components, as shown in FIG. 4.

The neck can comprise a fretboard 33 connected to the neck between the string and the neck. The fretboard 33 can be a decorative addition to the neck and can comprise a series of frets extending across the fretboard 33 perpendicularly to the string.

The neck can comprise a tuner 34. The tuner 34 can vary tension in the string 11 so that the vibrating string produces a desired pitch.

The neck can comprise a nut 36 positioned along the neck medial the tuner 34 and the body 20. The nut 36 contacts the string 11 so that the string presses the nut 36 into the neck. The nut 36 spaces apart the string 11 and the neck 30 proximal the head.

The neck can comprise an elongated component, for example the elongated component 37. Elongated components, as used here and throughout, extend substantially along the entire neck from the head throughout the tail. Furthermore, elongated components are length-wise continuous and so are substantially free of joints, hard spots, and various other interruptions along the length of the elongated component. Elongated components cause the neck to maintain a substantially smoothly curved shape along the length of the neck when the string is stretched between the head and the tail.

The instrument comprises a bridge 12. The bridge 12 is mounted to the soundboard 24 and the bridge 12 is positioned between the string 11 and the soundboard 24 so that the string presses the bridge into the soundboard.

As shown in FIG. 4, the bridge defines an interaction region 25 of the soundboard. The interaction region is wholly beneath the bridge and comprises the soundboard within the silhouette of the bridge when viewed from above the bridge.

When the string 11 vibrates, string vibrations are transmitted via the bridge 12 to the soundboard interaction region 25, causing the soundboard 24 to vibrate and generate sounds. String vibrations through the bridge to the interaction region of the soundboard are defined to be direct string vibrational interactions.

The bridge is selectively positioned on the soundboard where the soundboard is highly vibrationally responsive, so that direct string vibrational interactions generate sounds with optimal timbre and tone.

The soundboard is isolated from string vibrational interactions other than through the bridge to the interaction region.

The string contacts only the neck, at the head and the tail, and the bridge. While some string vibrations are transmitted to the neck via the connections to the neck, these vibrations are significantly attenuated in comparison to the string vibrations through the bridge.

For example, at the head, the string 11 connects to the tuner 34 and contacts the nut 36. Both of these connections are proximal nodes on the vibrating string where vibration amplitude is minimal. Furthermore, any string vibration transmitted to the neck at the head must travel through the neck to the body in order to reach the soundboard. The neck material largely damps the vibrations as they travel towards the body.

Similarly, at the tail, the string connects to the tail distal the bridge. The connection at the tail is proximal a node on the vibrating string where the vibration amplitude is minimal. On the instrument 10, the string 11 connects to the tail 32 via the tailpiece 38 distal the bridge 12.

The string proceeds from the bridge to the tail, bypassing the soundboard so as to minimize string vibrations transmitted to the soundboard except via the bridge.

"Bypass" as used here and throughout means the string does not contact the soundboard along the string between the bridge and the tail.

String vibrations transmitted to the neck at the tail must travel through the tail to the body in order to reach the soundboard. The tail material largely damps these vibrations as they travel towards the body.

Any residual vibrations in the neck—including the tail, where the neck joins with the body, are transmitted to the glued edges and glued block surfaces joining the body sides, body bottom, and body top. As stated before, these glued connections are not vibrationally responsive and vibrations transmitted thusly are substantially damped out.

The instrument can have a soundpost connecting the soundboard and the body bottom across the hollow body and distal a body side. Soundposts are utilized to create sympathetic vibrations between the soundboard and the body bottom. Such sympathetic vibrations help to amplify the sounds produced by the soundboard. Vibrational interactions between the soundboard and a soundpost are not direct string vibrational interactions, as defined in this application.

The soundpost primarily transmits soundboard vibrations to other parts of the body from the soundboard, not vice versa, so vibrations propagate from the soundboard to the soundpost and then into the body. Some vibrations can be reflected back from the body through the soundpost to the soundboard, however these vibrations are significantly attenuated compared to the direct string vibration interactions through the bridge at the interaction region.

String instruments that connect strings only to a neck are known in the art. However, known prior art instruments all include elements, other than the bridge, that act upon the soundboard, including on the soundboard proximal the bridge, In the instrument of the invention, the bridge provides the direct path for string vibrations to act on the soundboard. The string vibrational interactions occur directly at the interaction region of the soundboard and occur only through the bridge.

The string can connect to the tail via a tailpiece 38. The tailpiece 38 extends from the tail 32 outwards through the soundboard 24. The tailpiece 38 bypasses the soundboard 24 by extending through a tailpiece hole 26 in the soundboard. The tailpiece hole 26 enables the tailpiece 38 to be wholly spaced apart from the soundboard so that the tailpiece 38 interaction with the soundboard is minimized.

Stretching the string can cause the tail to change position with respect to the bridge. In some cases, the tail can move sufficiently to contact the soundboard when the string is stretched. It can be advantageous to selectively position the tail with respect to the bridge so that the tail does not contact the soundboard.

The instrument can comprise a tail adjuster for selectively positioning the tail with respect to the bridge.

Figure 8:
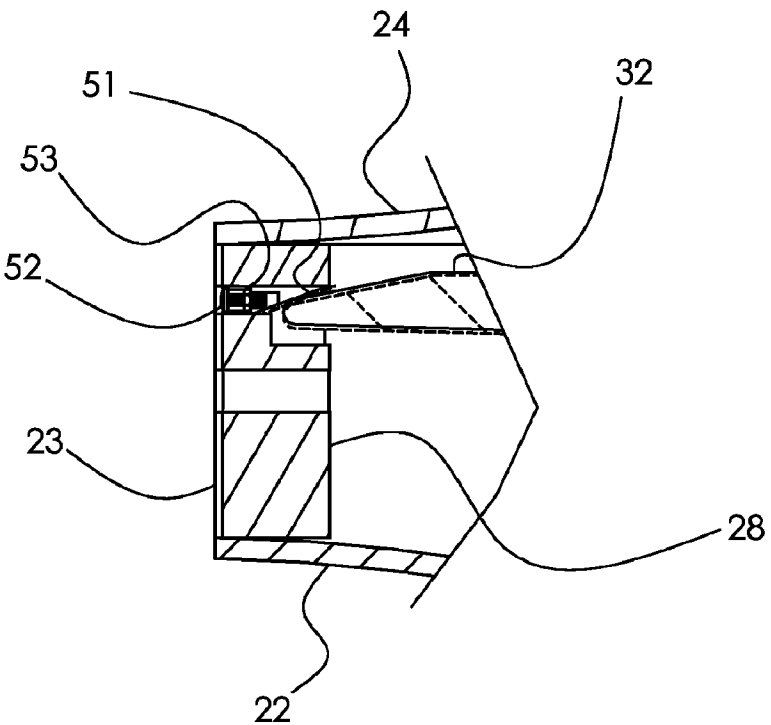
FIG. 8 is a detail view indicated by line 8-8 showing a tail adjuster.
Figure 9:
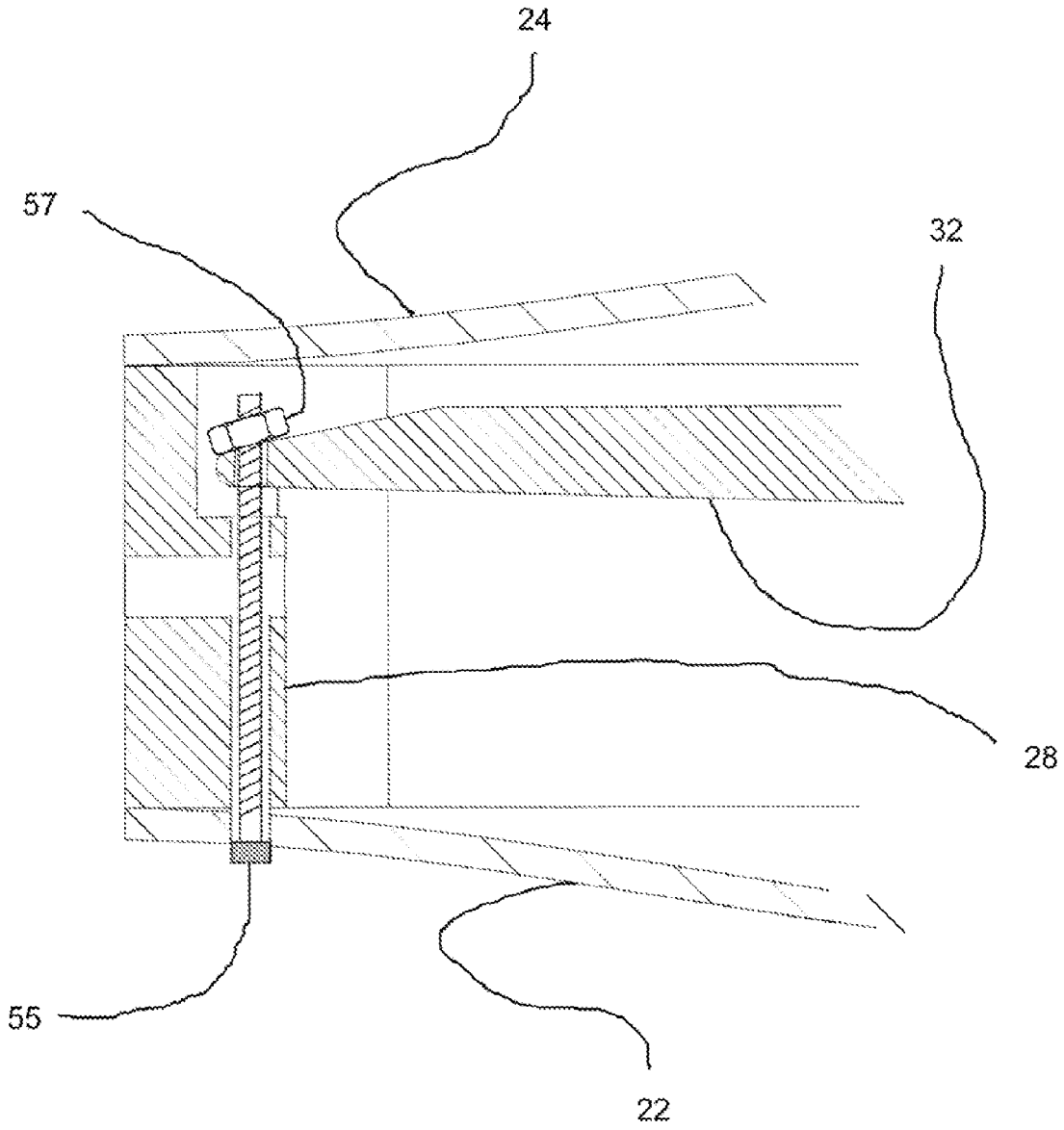
FIG. 9 is a detail section view of an instrument showing an alternative tail adjuster.
Figure 10:
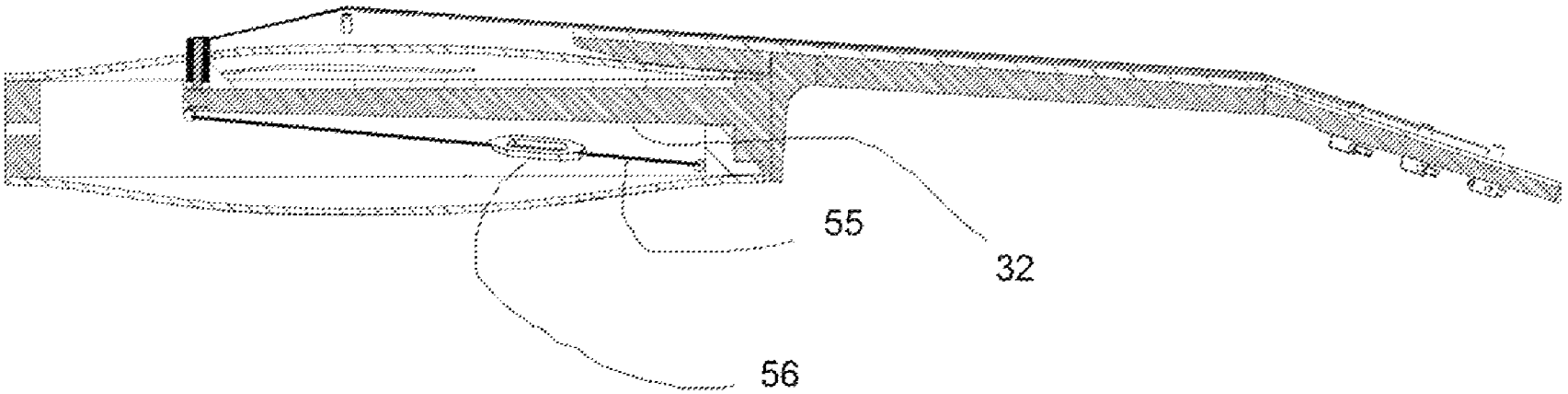
FIG. 10 is an section view of an instrument showing another alternative tail adjuster.

As seen in FIG. 2 and in FIG. 8, the instrument 10 can have a tail adjuster, for example the tail adjuster 50. The tail adjuster is mounted to the body and is spaced apart from the soundboard. The tail adjuster modifies the position of the tail with respect to the bridge.

The tail adjuster 50 comprises a wedge 51. The wedge 51 contacts the heel block 28 and the tail 32 so that moving the wedge 51 towards and away from the bridge 12 causes the tail 32 to move away from and towards the soundboard 24, respectively.

The tail adjuster 50 further comprises a wedge nut 52 fixed to the heel block 28 and a wedge screw 53 threaded into the wedge nut 52 so that rotating the wedge screw 53 causes the wedge 52 to move towards and away from the bridge 12.

Various components can be configured to move the wedge 52 towards and away from the bridge.

Alternatively, the tail adjuster can comprise a tail screw 54 rotatably mounted to the heel block 28. The tail screw 54 is substantially perpendicular to the tail 32 and threaded into the tail nut 57 mounted on the tail 32. Rotating the tail screw 54 in the tail nut 57 causes the tail 32 to move towards and away from the soundboard 24. Various components can be substituted for the tail screw and the tail nut, for example components that adjust via characteristics other than threads.

Alternatively, the tail adjuster can comprise adjustable linkage for modifying the position of the tail with respect to the bridge. The adjustable linkage can comprise a turnbuckle 56 and a cable, such as the cable 55. The turnbuckle 56 and the cable 55 can connect together and extend to connect the tail 32 and the neck block 29. Turning the turnbuckle can pull and release the tail 32, and change the position of the tail 32 with respect to the bridge 12. Various other adjustable linkages can be utilized, for example a ratchet and cable, a winch and cable, wire, string, and gut in place of cable, and various combinations thereof.

The aforementioned tail adjuster components can be combined with each other and with various other means to modify the position of the tail with respect to the bridge. Similarly, various other standalone means and combinations thereof can modify the position of the tail with respect to the bridge.

The instrument can comprise a transducer. A transducer can detect mechanical vibrations such as string vibrations and soundboard vibrations and convert them into electrical signals. The electrical signals can then be amplified and recorded.

A transducer can be an electromagnetic guitar pickup, a piezoelectric pickup, a multi-transducer pickup, a microphone, and various other transducers and combinations thereof.

Figure 11:
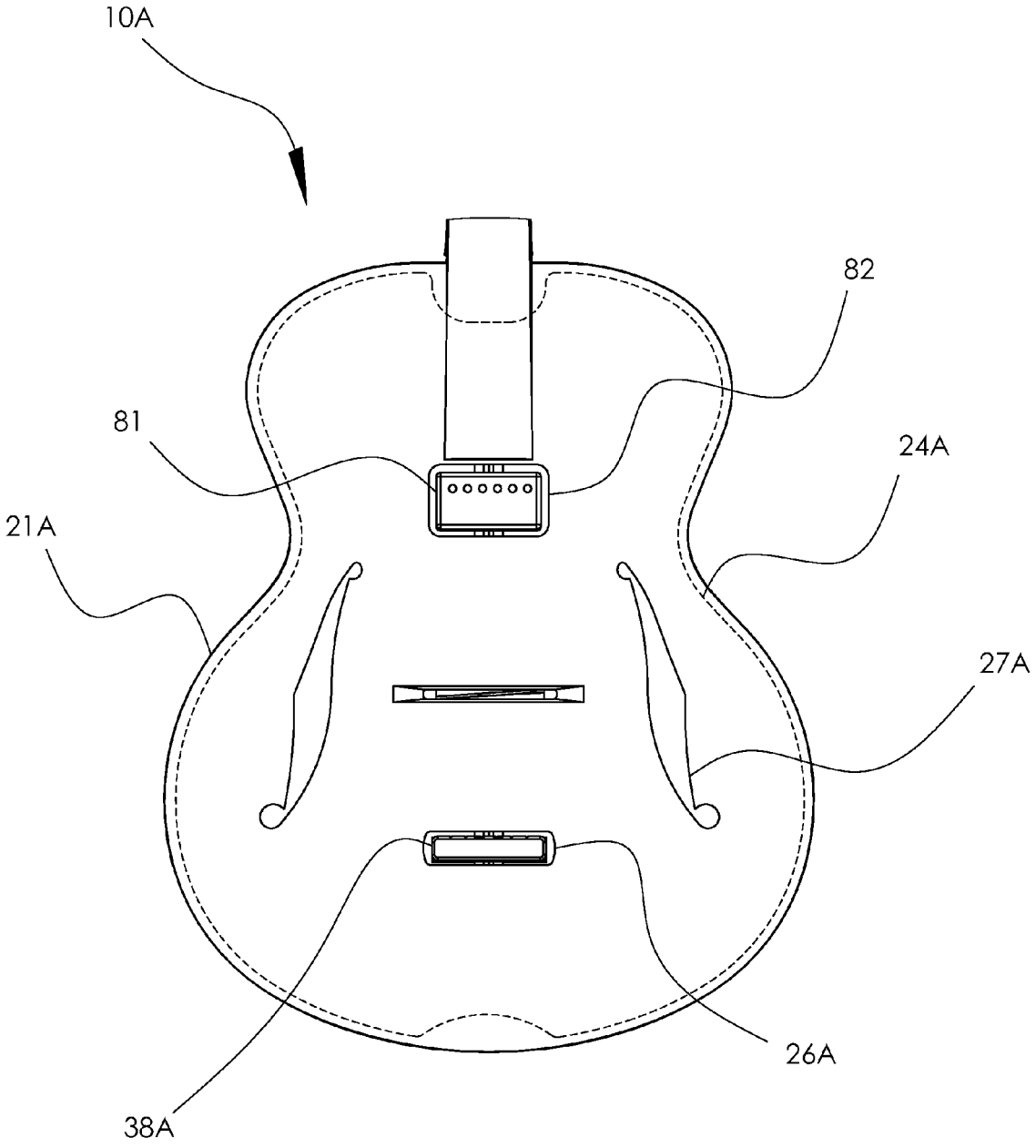
FIG. 11 is a top view of an alternative embodiment of the instrument.
Figure 12:
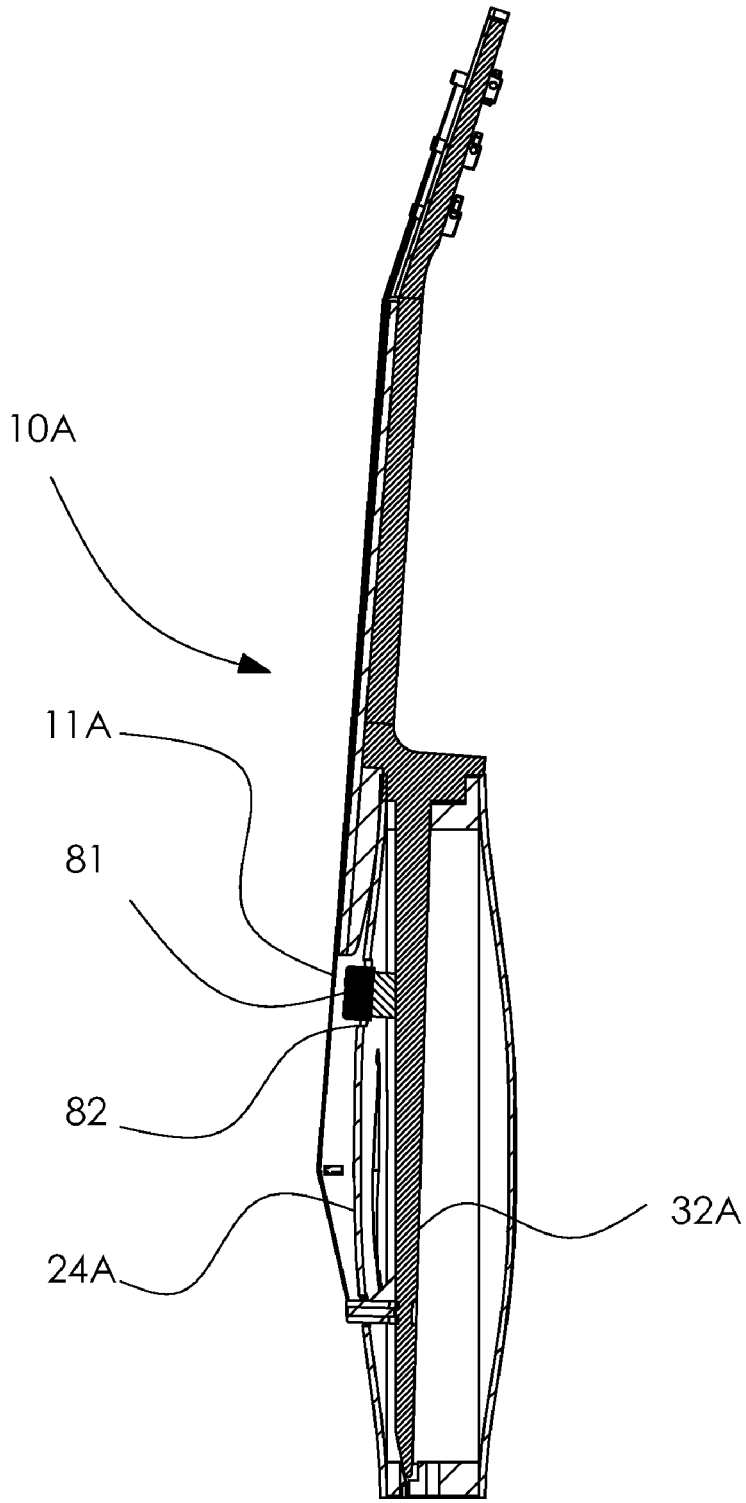
FIG. 12 is a side section view of the alternative embodiment of the instrument.

Some transducers, like the electromagnetic pickup, are most effective when positioned proximal the guitar string. The instrument 10A, as shown in FIG. 11 and FIG. 12, has a transducer 81 proximal the string 11A.

The transducer 81 is mounted to the tail 32A. The transducer 81 extends outward from the tail 32A through the soundboard 24A. The transducer 81 bypasses the soundboard 24 by extending through a transducer hole 82 in the soundboard. The transducer hole 82 enables the transducer 81 to be wholly spaced apart from the soundboard to prevent the transducer 81 from interacting with the soundboard.

The invention claimed is:

1. A stringed instrument with a hollow body, the body being formed by body sides, a body bottom, and a body top, the instrument comprising:

a vibrationally-responsive soundboard forming at least a part of the body top, the soundboard having an interaction region where string vibrational interactions occur directly through a bridge; the interaction region being isolated from string vibrational interactions other than through the bridge;

the bridge contacting the soundboard at the interaction region and defining the interaction region beneath the bridge;

a neck having a head including a nut and a tail including a tailpiece, where the tailpiece extends from the tail outwards through the soundboard via a tailpiece hole so that the tailpiece is wholly spaced apart from the soundboard;

the neck comprising an elongated component, the elongated component being lengthwise-continuous along the entire neck from the nut throughout the tail to the tailpiece;

the neck being fixed to the body only medial the head and the tail so that the head extends outward from the body and so that the tail extends into the body;

the tail being spaced apart from the soundboard;

a string being connected at the head and the tail and being stretched between the nut and the tailpiece;

the string pressing the bridge into the soundboard so that as the string vibrates the string vibrational interactions through the bridge occur directly at the interaction region;

the string, between the bridge and the tail, bypassing the soundboard so that string vibrational interactions transmitted through the soundboard to the interaction region are minimized; and a tail adjuster, the tail adjuster in use selectively positioning the tail with respect to the bridge, and the tail adjuster being mounted to the instrument and being spaced apart from the soundboard.

2. The instrument of claim 1 further comprising:

a magnetic pickup mounted to the tail;

the magnetic pickup extending from the tail outwards through the soundboard via a transducer hole so that the magnetic pickup is wholly spaced apart from the soundboard; and the magnetic pickup being proximal the string.

3. The instrument of claim 1 wherein the neck maintains a substantially smoothly-curved shape along the neck and throughout the tail, when the neck is deflected by the stretched string.

4. The instrument of claim 1 wherein the tail adjuster comprises:

a wedge positioned between the body and the tail; and the wedge moving linearly to selectively separate the body and the tail.

5. The instrument of claim 1 wherein the tail adjuster comprises:

adjustable linkage connected to, and between, the tail distal the head and the body medial the tail and the head;

the adjustable linkage being lengthwise-adjustable to progressively position the tail with respect to the bridge.

6. The instrument of claim 1 further comprising:

a transducer mounted to the tail;

the transducer extending from the tail outwards through the soundboard via a transducer hole so that the transducer is wholly spaced apart from the soundboard; and the transducer being proximal the string.

7. The instrument of claim 5 wherein the tail adjuster is connected to the body at the neck block.

8. A stringed instrument with a hollow body, the hollow body being formed by body sides, a body bottom, and a body top, the instrument comprising:

a vibrationally-responsive soundboard forming at least a part of the body top, the soundboard having an interaction region where string vibrational interactions occur directly through a bridge;

the interaction region being isolated from string vibrational interactions other than string vibrational interactions through the bridge;

the bridge contacting the soundboard at the interaction region and defining the interaction region beneath the bridge;

a neck comprising:

a head and a tail;

the neck being fixed to the body only medial the head and the tail so that the head extends outward from the body and so that the tail extends into the body;

the tail being spaced apart from the soundboard;

a string, the string being stretched between the head and the tail;

the string pressing the bridge into the soundboard so that as the string vibrates the string vibrational interactions through the bridge occur directly at the interaction region;

the string, between the bridge and the tail, bypassing the soundboard so that the string vibrational interactions transmitted to the interaction region, other than through the bridge, are minimized; and a tail adjuster, the tail adjuster in use selectively positioning the tail with respect to the bridge, and the tail adjuster being mounted to the instrument and being spaced apart from the soundboard.

9. The instrument of claim 8 wherein the tail further comprises:

a tailpiece, the tailpiece extending from the tail outwards through the soundboard via a tailpiece hole so that the tailpiece is wholly spaced apart from the soundboard; and the string being connected to the tail via the tailpiece.

10. The instrument of claim 8 wherein the neck further comprises:

an elongated component;

the elongated component extending lengthwise from the head substantially throughout the tail; and the elongated component being lengthwise-continuous from the head through the tail.

11. The instrument of claim 8 wherein the tail adjuster comprises:

a wedge positioned between the body and the tail; and the wedge being movable to selectively separate the body and the tail.

12. The instrument of claim 8 wherein the tail adjuster comprises:

adjustable linkage connected to, and between, the tail distal the head and the body medial the tail and the head;

the adjustable linkage being lengthwise-adjustable to progressively position the tail with respect to the bridge.

13. The instrument of claim 8 further comprising:

a magnetic pickup mounted to the tail;

the magnetic pickup extending from the tail outwards through the soundboard via a transducer hole so that the magnetic pickup is wholly spaced apart from the soundboard; and the magnetic pickup being proximal the string.

14. The instrument of claim 13 wherein the neck maintains a substantially smoothly-curved shape along the neck and throughout the tail, when the neck is deflected by the stretched string.

15. A stringed instrument comprising:

a hollow body, the body being formed by body sides, a body bottom, and a body top;

a vibrationally-responsive soundboard forming at least a part of the body top;

the soundboard having an interaction region where string vibrational interactions occur directly through a bridge;

the interaction region being isolated from string vibrational interactions other than through the bridge due to attenuation of vibrational interactions reaching the interaction region via other paths that pass through intervening material;

the bridge contacting the soundboard at the interaction region and defining the interaction region beneath the bridge;

a neck having a head and a tail;

the neck being fixed to the body medial the head and the tail so that the head extends outward from the body and so that the tail extends into the body;

the tail being spaced apart from the soundboard;

the neck maintaining a substantially smoothly-curved shape along the neck and throughout the tail;

a string being stretched between the head and the tail;

the string pressing the bridge into the soundboard so that as the string vibrates the string vibrational interactions through the bridge occur directly at the interaction region;

the string, between the bridge and the tail, bypassing the soundboard so that string vibrational interactions transmitted through the soundboard to the interaction region are minimized; and a tail adjuster, the tail adjuster in use selectively positioning the tail with respect to the bridge, and the tail adjuster being mounted to the instrument and being spaced apart from the soundboard.

* * * * *